United States Patent [19]

Ireland

[11] 4,270,909

[45] Jun. 2, 1981

[54] DEVICE AND METHOD FOR FOLDING SELF-SEALING ENVELOPE FLAPS

[75] Inventor: Roger H. Ireland, Bristol, England

[73] Assignee: DRF (UK) Limited, Bristol, England

[21] Appl. No.: 47,806

[22] Filed: Jun. 12, 1979

[30] Foreign Application Priority Data

Jun. 19, 1978 [GB] United Kingdom ..... 27294/78

[51] Int. Cl.[3] ..... B31B 1/56

[52] U.S. Cl. ..... 493/245; 493/249; 493/261; 493/420; 493/453; 493/920

[58] Field of Search ..... 93/61 R, 62, 63 R, 63 M, 93/84 FF, 84 R; 270/61 R, 69; 53/266 A, 206

[56] References Cited

U.S. PATENT DOCUMENTS

| | | | |
|---|---|---|---|
| 2,019,946 | 11/1935 | Winkler et al. | 93/62 |
| 2,163,038 | 6/1939 | Heywood | 93/62 |
| 3,793,926 | 2/1979 | Honsel | 93/62 |
| 3,897,720 | 8/1975 | Hiersteiner | 93/61 R |

*Primary Examiner*—James F. Coan

*Attorney, Agent, or Firm*—Larson and Taylor

[57] ABSTRACT

A device and method for folding the main and secondary flaps of self-sealing envelopes into the inoperative condition. The envelopes (11) are fed, bottom edge leading, into a roller (20), the front panel of the envelope being in contact with the roller. The bottom edge lifts off the roller and the envelope is arrested and temporarily supported by abutment means (38,40,44) while the main flap (16) of the envelope is held to the roller by suction (22,24) and carried around the roller and thereby folded relative to the front panel of the envelope. In this position of the envelope, the secondary flap (18) slidably engages the surface of the roller and is then arrested by stop means (28) which carry the secondary flap (18) around and fold it relative to the back panel of the envelope.

4 Claims, 9 Drawing Figures

DEVICE AND METHOD FOR FOLDING SELF-SEALING ENVELOPE FLAPS

FIELD OF THE INVENTION

Figure 1:
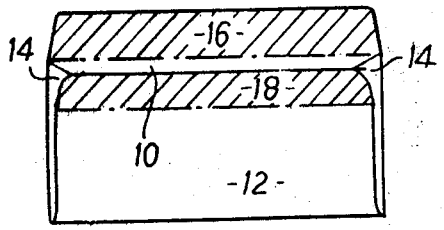

This invention relates to machines for producing self-sealing envelopes, and more particularly to folding the flaps thereof into an inoperative condition.

BACKGROUND OF THE INVENTION

A self-sealing envelope has a main flap extension of the top edge of the front panel of the envelope and a secondary flap extension of the top edge of the back panel of the envelope, both flaps having an adhesive material (usually latex adhesive) applied to the same side, the main flap being foldable over the secondary flap so that the two layers of adhesive come into contact and seal the flaps together to close the envelope. Both flaps are foldable downwardly into an inoperative condition in which the adhesive surfaces lie face-to-face with surfaces of the envelope not having adhesive. To put this another way: whereas, in common with conventional envelopes, the main flap can be folded downwardly prior to the envelope being used and is prevented from adhering to the back panel of the envelope because the adhesive has not been moistened, in the case of a self-sealing envelope a secondary flap of the back panel of the envelope carries the complementary layer of adhesive and is also foldable downwardly so as to keep this complementary layer out of contact with the adhesive on the main flap until such time as it is desired to close the envelope, whereupon the secondary flap is raised to expose the adhesive layer.

SUMMARY OF THE INVENTION

According to the present invention there is provided for use in a machine for producing self-sealing envelopes a device for folding the main and secondary flaps into the inoperative condition, the flaps having been previously coated with adhesive, the device comprising a roller for receiving a succession of envelopes with their bottom edges leading and their front panels in contact with the roller, first stop means on the roller for arresting the bottom edge of an envelope and thereby defining its position on the roller, suction means on the roller spaced from the first stop means so as to apply suction to the main flap of the envelope and thereby secure it to the surface of the roller, abutment means adjacent the surface of the roller for engaging the front panel of the envelope as it lifts from the surface of the roller and temporarily arresting its movement with the roller whereby the main flap on being carried around with the roller folds relative to the front panel, and for initially supporting the envelope in a position relative to the surface of the roller so that as the main flap is carried around with the roller the upper edge of the secondary flap bears slidably upon the surface of the roller, and second stop means on the roller for arresting the upper edge of the secondary flap when in said sliding engagement with the roller so as to carry it around the roller and thereby fold it relative to the back panel. Said abutment means preferably includes an element arranged so as to temporarily trap the bottom portion of the back panel of the envelope to maintain the envelope initially in said position, the bottom edge of the envelope moving free of the said element as the movement of the main flap with the roller draws the envelope around the portion of said abutment means which engages the the front panel of the envelope.

BRIEF DESCRIPTION OF THE DRAWINGS AND DESCRIPTION OF EXEMPLARY EMBODIMENTS

Figure 2:
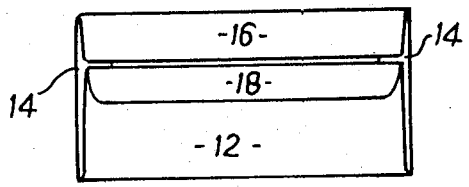
Figure 3:
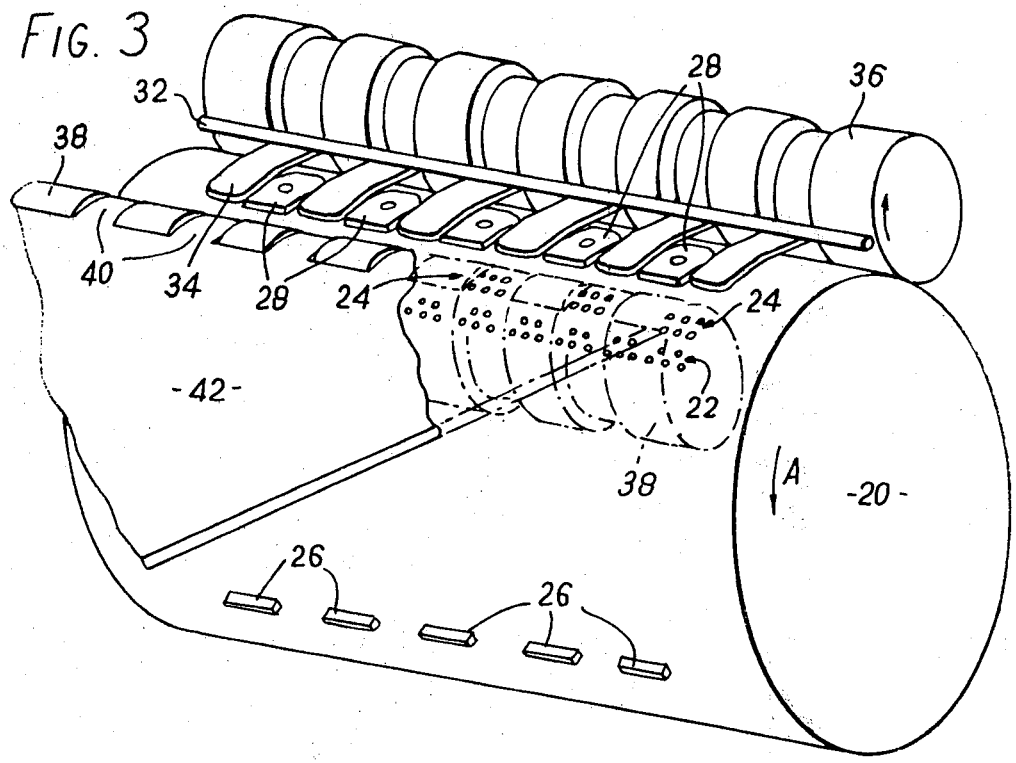
Figure 4:
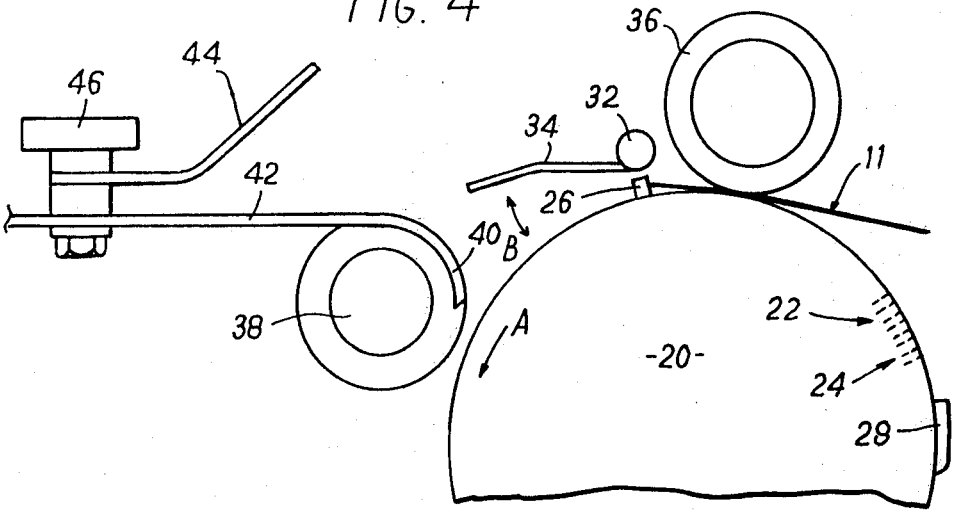
Figure 5:
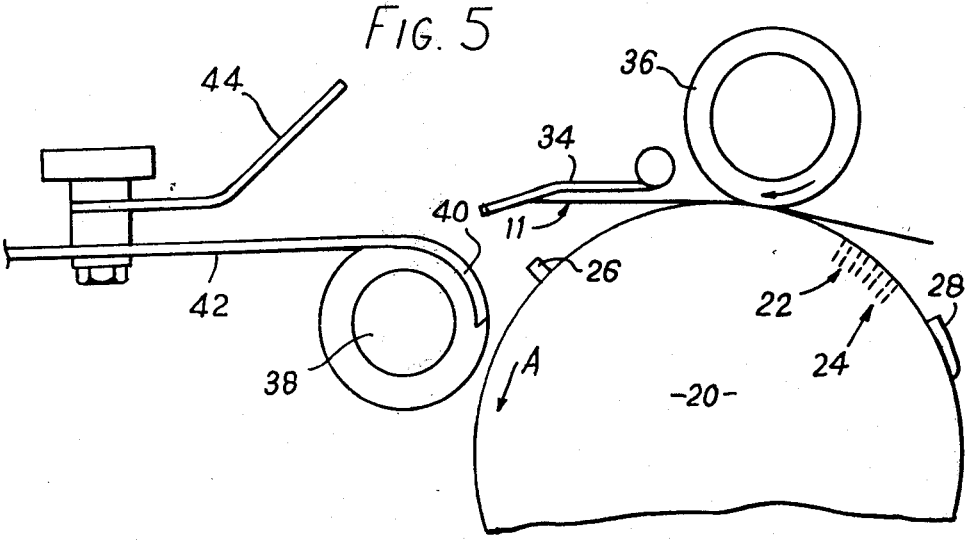

In order that the invention may be more clearly understood, one embodiment will now be described with reference to the accompanying drawings, wherein:

FIG. 1 shows a plan view of a self-sealing envelope prior to folding of the flaps, FIG. 2 shows a similar view of the envelope with the flaps folded, FIG. 3 shows a simplified perspective view of part of the device of the present invention, and FIGS. 4 to 9 show diagrammatic side views of the device in successive stages of operation.

Referring to the drawings, and firstly to FIGS. 1 and 2; a conventional self-sealing envelope has a front panel 10 and back panel 12 secured together by side flaps 14. A main closure flap 16 is provided as an extension of the upper edge of the front panel 10, and a secondary closure flap 18 is provided as an extension of the upper edge of the back panel 12. Prior to folding of the closure flaps, they are each coated on the same side with a self-sealing latex adhesive, as indicated by the hatching in FIG. 1. When the two closure flaps are folded downwardly as shown in FIG. 2, the adhesive layers lie face-to-face with portions of the envelope which do not carry adhesive. When it is desired to seal the envelope, both closure flaps are raised, and then the main closure flap 16 is folded over onto the raised secondary closure flap 18 so that the two adhesive surfaces come into contact and adhere together. The device of the present invention is concerned with folding the closure flaps from the position shown in FIG. 1 to the position shown in FIG. 2, and effecting this folding at high speed as part of an envelope making machine.

Referring to FIG. 3; the device comprises a steel roller 20 which is driven so as to rotate in the direction of the arrow A. The roller is provided with internal ducting (not shown) for connection to a source of vacuum, the ducting being connected to openings on the surface of the roller. These openings are arranged as a leading band of openings 22 extending substantially continuously across the roller, and behind this leading band a series of groups 24 of openings spaced apart by unapertured regions. The total peripheral extent of the region having these suction openings 22,24 is substantially the same as the width of the main flap 16 of the envelope. In practice, a wider region of suction openings may be provided to allow for different sizes of envelopes, and any openings which are not desired for a particular size of envelope can be blanked off. Ahead of the leading band 22 of openings, and spaced therefrom by the height of the front panel of the envelope, is a row of first stop elements 26. These can be circumferentially adjustable to accommodate different sizes of envelopes. Behind the leading band 22 of openings and alternating with the groups 24 of openings the roller is provided with a row of secondary stop elements 28. Again, the circumferential setting of these stop elements can be adjusted.

A bar 32 is closely spaced from the surface of the roller and extends parallel thereto. The bar carries a series of tongues 34 arranged so as to lie over the groups of apertures 24 and between the second stop elements 28 as the roller rotates. The bar 32 is pivotable to a small degree so that tongues can be raised and lowered as indicated by the double ended arrow B (see FIG. 4). A rubber surfaced roller 36 is located in contact with the roller 20 just before the bar 32. Shortly after the ends of the tongues 34 is located a further roller 38 which is slightly spaced from the surface of the roller 20. The roller 38 is provided with a series of circumferential grooves which freely receive extension elements 40 at the edge of a table 42. Extension elements 40 are curved so as to follow the curvature of the roller 38 within the circumferential grooves (see FIG. 4). As can be seen also from FIG. 4, a plate 44 which extends towards the roller 36 is inclined upwardly at an acute angle with respect to the table 42. The plate 44 is adjustably secured to the table by means of a screw clamp 46.

Figure 6:
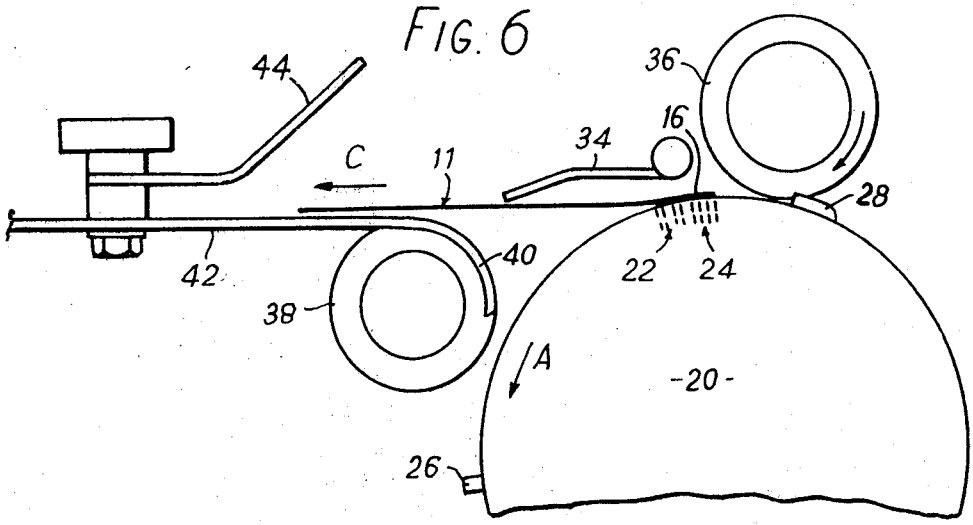
Figure 7:
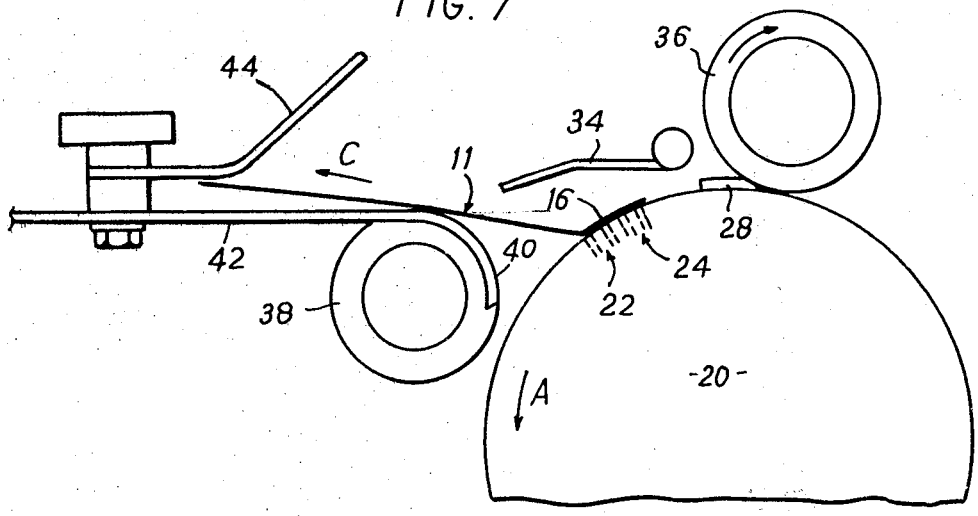
Figure 8:
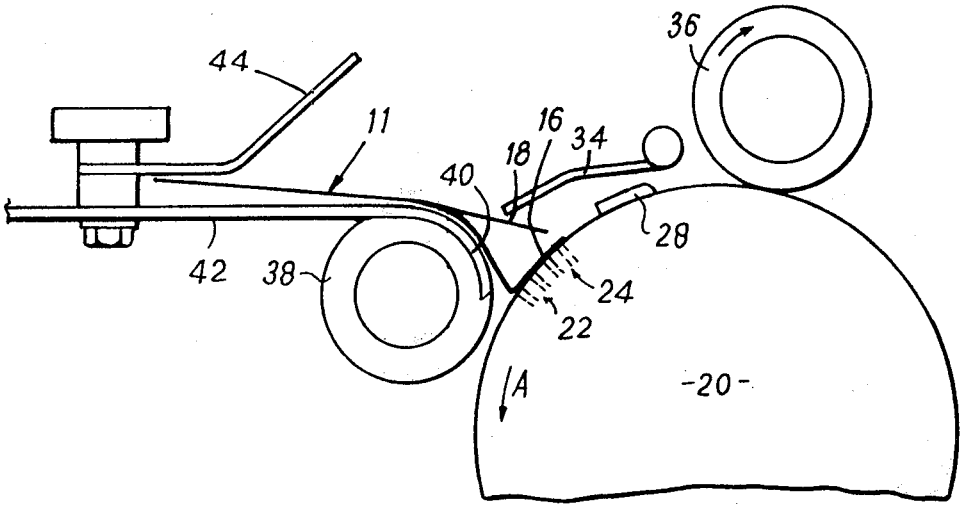
Figure 9:
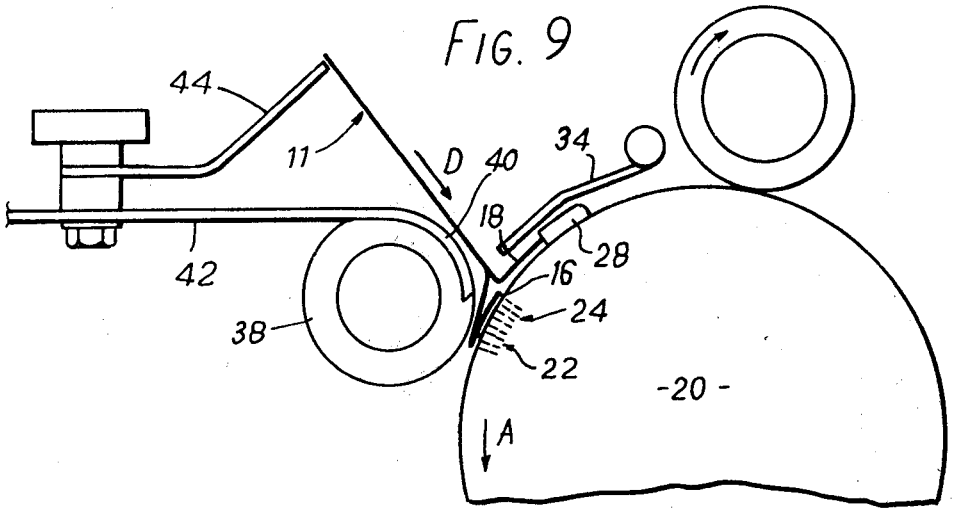

In operation, the self-sealing envelopes are produced on a conventional machine, and adhesive is applied to the extended closure flaps to produce a succession of envelopes in the form shown in FIG. 1. These envelopes travel with their bottom edge leading, and are delivered towards the surface of the roller 20 on the upstream side of the nip with the roller 36. The bottom edge of the envelope (designated 11 in FIG. 4 onwards) is arrested by engagement with the stop elements 26, and proceeds into the nip between the rollers 20,36. On emerging from the nip between these rollers, the bottom edge of the envelope passes under the bar 32 and its associated tongues 34, but, since there is nothing to hold it to the surface of the roller, the front panel of the envelope lifts from the surface of the roller after leaving the nip, as can be seen from FIG. 5. Guided if necessary by the tongues 34 which are in the raised condition, the front edge of the envelope proceeds up over the roller 38 and extension elements 40 of the table 42, as can be seen in FIG. 6. At the same time, the main flap 16 of the envelope is passing through the nip and lies over the suction apertures 22,24, at which point the suction is applied to these apertures, for example by means of a conventional rotary valve at one end of the roller 20. The flap 16 is therefore secured to the surface of the roller, and this provides transport for the envelope after leaving the nip. The continued travel of the main flap 16 with the roller 20 past the nip of the roller 36 causes the envelope to continue travelling over the table 42 in the direction indicated by the arrow C until the bottom edge of the envelope engages the abutment provided by the plate 44 as shown in FIG. 7. This arrests further movement of the envelope in that direction, and holds the main body of the envelope in approximately the same position relative to the surface of the roller, as can be seen in FIG. 7, while the main flap 16 continues to travel with the roller towards the gap between the roller 20 and the roller 38. In so doing, as can be seen from FIG. 8, the flap 16 starts to fold relative to the front panel of the envelope, the fold being properly formed by passage between the rollers 20,38. Thereafter, the continued movement of the roller 20 starts to draw the main body of the envelope around the roller 38, and hence back in the direction indicated by the arrow D in FIG. 9. Initially, this causes the upper edge of the secondary flap 18 to bear slidably upon the surface of the roller 20, and eventually brings the bottom edge of the envelope clear of the plate 44. The tongues 34 are brought into their lowered positions as this happens. The upper edge of the flap 18 is engaged by the second stop elements 28, and thereby caused to move with the roller. The main body of the envelope, being free of the plate 44 then tends to assume a position generally radial with respect to the roller 20, as can be seen from FIG. 9. It will also be apparent that the secondary closure flap 18 is at this point being folded with respect to the back panel of the envelope, and the tongues 34 prevent the flap folding in the wrong direction, particularly if the envelope tends to fill with air and billow out as it is brought backwards in the direction of arrow D. Continued movement of the roller 20 draws the secondary closure flap 18 together with the main body of the envelope through the gap between the rollers 20 and 38, thereby completing the fold between the secondary flap 18 and back panel of the envelope. The envelope is now in the condition shown in FIG. 2, and can be delivered to a conventional envelope collating mechanism.

I claim:

1. In or for a machine for producing self-sealing envelopes of the type including a main flap located at the top of the front panel of the envelope and a secondary flap located at the top of the back panel of the envelope, a device for folding the main and secondary flaps of an envelope into an inoperative condition wherein the flaps do not provide sealing of the envelope, the flaps having been previously coated with adhesive and the flaps being foldable into an operative condition wherein the adhesive on the respective flaps is brought into contact to provide sealing of the envelope; the device comprising a roller for receiving a succession of envelopes with their bottom edges leading and their front panels in contact with the roller, first stop means on the roller for arresting the bottom edge of an envelope and thereby defining the position of the envelope on the roller, suction means on the roller spaced from the first stop means so as to apply suction to the main flap of the envelope and thereby secure the main flap to the surface of the roller, abutment means adjacent the surface of the roller for engaging the front panel of the envelope as the front panel lifts from the surface of the roller and temporarily arresting the movement of the front panel with the roller whereby the main flap, on being carried around with the roller, folds relative to the front panel, and for initially supporting the envelope in a position relative to the surface of the roller so that as the main flap is carried around with the roller the upper edge of the secondary flap bears slidably upon the surface of the roller, and second stop means on the roller for arresting the upper edge of the secondary flap when in said sliding engagement with the roller so as to carry the secondary flap around the roller and thereby fold the secondary flap relative to the back panel.

2. A device according to claim 1 wherein said abutment means includes an element arranged so as to temporarily trap the bottom portion of the back panel of the envelope to maintain the envelope initially in said position, the bottom edge of the envelope moving free of the said element as the movement of the main flap with the roller draws the envelope around the portion of said abutment means which engages the front panel of the envelope.

3. A device according to claim 1 which further includes movable guide elements adjacent the surface of the roller which elements, in a raised condition, allow the bottom edge portion of the envelope to move generally tangentially from the roller into engagement with said abutment means, and, in a lowered condition guide the secondary flap in its folding relative to the back panel.

4. In the production of self-sealing envelopes of the type including an adhesively coated main flap located at the top of the front panel of the envelope and an adhesively coated secondary flap at the top of the back panel, a method of folding the adhesively coated main and secondary flaps of an envelope into an inoperative condition wherein the adhesively coated flaps are not in contact with each other, and hence no sealing is provided; wherein the method comprises feeding the envelope onto a rotating roller with the bottom edge of the envelope leading and the front panel of the envelope in contact with the surface of the roller, allowing the bottom edge portion of the envelope to leave the roller generally tangentially but retaining by suction the main flap on the surface of the roller, engaging the front panel of the envelope as the front panel lifts from the surface of the roller and temporarily arresting the movement of the front panel with the roller whereby the main flap, on being carried around with the roller, folds relative to the front panel, initially supporting the envelope in a position such that as the main flap is carried around with the roller the upper edge of the secondary flap bears slidably upon the surface of the roller, arresting the upper edge of the secondary flap when in said sliding engagement with the roller so as to carry the secondary flap around the roller and thereby fold the secondary flap relative to the back panel of the envelope.

* * * * *

UNITED STATES PATENT AND TRADEMARK OFFICE

CERTIFICATE OF CORRECTION

PATENT NO. : 4,270,909

DATED : June 2, 1981

INVENTOR(S) : Ireland, Roger H.

It is certified that error appears in the above-identified patent and that said Letters Patent are hereby corrected as shown below:

Please amend the name of the assignee from "DRF (UK) LIMITED" to read --DRG (UK) LIMITED--.

Signed and Sealed this

*Seventeenth* Day of *November 1981*

[SEAL]

*Attest:*

GERALD J. MOSSINGHOFF

*Attesting Officer*

*Commissioner of Patents and Trademarks*